US006549634B1

(12) United States Patent
Vonlanthen

(10) Patent No.: US 6,549,634 B1
(45) Date of Patent: Apr. 15, 2003

(54) BEHIND-THE-EAR HEARING AID

(75) Inventor: Andi Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/340,915

(22) Filed: Jun. 28, 1999

(51) Int. Cl.[7] ..... H04R 25/00
(52) U.S. Cl. ..... 381/322; 381/324; 381/330
(58) Field of Search ..... 381/322, 324, 381/330, 312, 314, 323

(56) References Cited

U.S. PATENT DOCUMENTS 3,257,516 A 6/1966 Knowles
4,354,065 A * 10/1982 Buettner ..... 179/107
4,620,605 A 11/1986 Gore et al.
5,640,457 A * 6/1997 Gnecco
6,031,923 A * 2/2000 Gnecco

FOREIGN PATENT DOCUMENTS

DE 87 13 089.0 3/1989
DE 94 08 054.2 8/1994

* cited by examiner

*Primary Examiner*—Huyen Le
*Assistant Examiner*—Dionne Harvey
(74) *Attorney, Agent, or Firm*—Pearne & Gordon LLP

(57) ABSTRACT

A behind-the-ear hearing aid is provided with an electric/acoustic transducer unit with a loud-speaker housing (53) in which there is a loud-speaker membrane 54. The housing (53) is spring-mounted in a capsule (59) in such a way that the capsule (59) and the loud-speaker housing (53) define an intermediate space ($U_{53}$). The front ($R_1$) of the membrane (54) is connected to the acoustic output (S) of the hearing aid, while the back ($R_2$) is coupled to the intermediate space ($U_{53}$) via coupling holes (55).

10 Claims, 5 Drawing Sheets

BEHIND-THE-EAR HEARING AID

This invention concerns a behind-the-ear hearing aid with a hook-shaped curved body that contains an acoustic/electric transducer, an electric/acoustic transducer, and an electronic unit. The electric/acoustic transducer has at least one loud-speaker with a membrane built into a loud-speaker housing.

In accordance with one aspect, the present invention relates to optimally using the space available on this type of hearing aid and thereby simultaneously improving its acoustic properties. This is achieved by a behind-the-ear hearing aid device that has a hook-shaped housing and an acoustical output. A capsule is mounted to the hook-shaped housing, wherein the capsule can be removably snapped into place in the hook-shaped housing. An electrical/mechanical transducer includes a transducer housing resiliently mounted in the capsule. The transducer housing defines an intermediate space between the transducer housing and the capsule. A membrane is in the transducer housing. The membrane has a first side and a second side. A first space is adjacent to the first side of the membrane and communicates with the acoustical output. A second space is adjacent to the second side of the membrane and communicates with the intermediate space.

In this way, the intermediate space provided between the hearing aid housing and the loud-speaker housing is used, practically completely, as a space for improving the acoustic behavior of the hearing aid. It was found that providing the intermediate space mentioned increases the low-tone range by several decibels. The acoustically effective space on the back of the membrane is improved greatly via creation of the intermediate space.

In one preferred embodiment, the capsule is used as a magnetic shield and for this use is preferably made of $\mu$ metal.

Extremely simple assembly and disassembly, especially of the loud-speaker housing with the loud speakers, is achieved by having the capsule include a cup, preferably a metal one, which is attached to the hearing aid housing on the open side. In one example, the construction permits snap-on connection.

The fact that the loud-speaker housing is basically cube-shaped and is tensed along four of its parallel edges by means of elastic mounting blocks in relation to the capsule, creates a very simple, basically floating mount for the loud-speaker housing.

The transducer unit also preferably snaps into the hearing aid housing and makes electrical contact with no solder points. The capsule fits into the housing so it can be removed, as mentioned. In the preferred embodiment, the capsule and the loud-speaker housing form a resonance space basically enclosing the latter on all sides.

The invention of the behind-the-ear hearing aid in the invention will next be explained giving examples with figures, which show one embodiment of this device preferred today.

Figure 1:
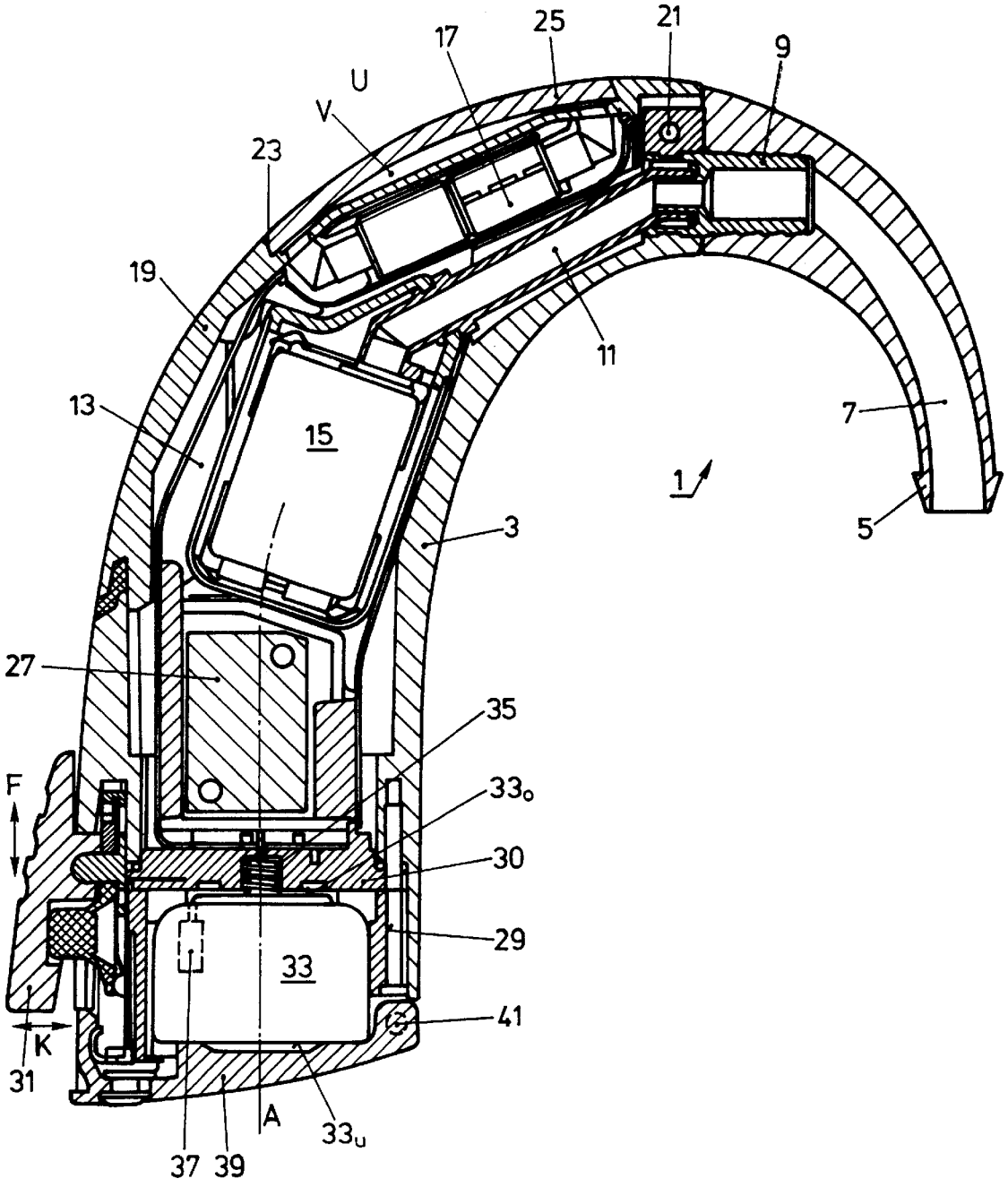
FIG. 1 shows a simplified behind-the-ear hearing aid of the invention in a longitudinal section.

FIG. 1 shows a somewhat simplified longitudinal section of the behind-the-ear hearing aid of the invention as a whole, where the individual function blocks and function parts are first described. The hearing aid 1 includes a horn-shaped curved, tubular basic body with a central axis A, which has a connecting support 5 for a coupling tube leading into the ear on the thinner, uncurved end, as an acoustic output. The connecting supports 5 can be exchanged for a tube support 9, which is set on or screwed on a basic housing.

The inner channel 7 of the connecting support 5 continues through the tubular support 9 into a transmission channel 11 in the basic housing 3. The transmission channel 11 in turn is coupled to an electric/acoustic transducer arrangement 15 in one compartment 13 of the basic housing 3.

Figure 2:
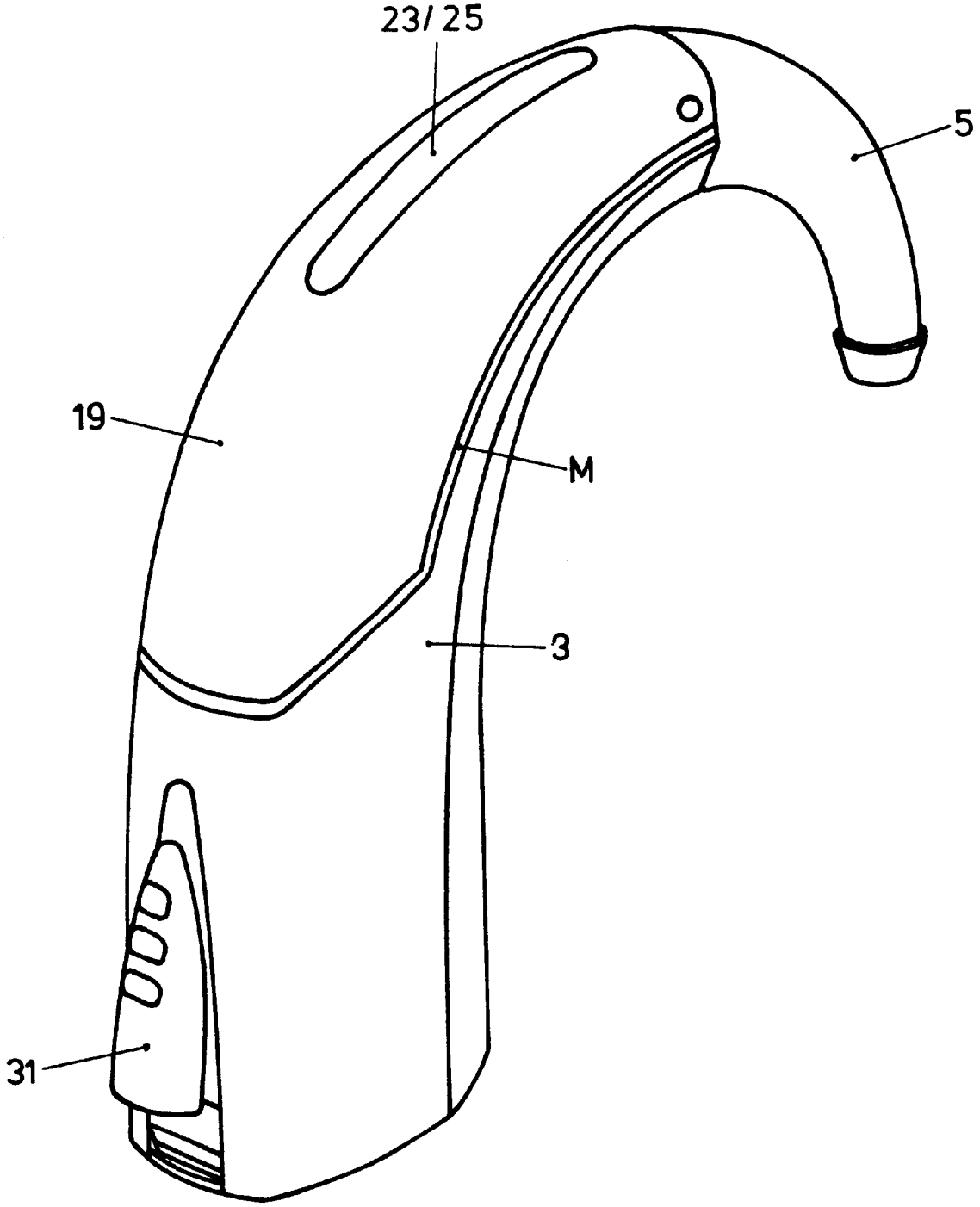
FIG. 2 shows a perspective view of the hearing aid of the invention.

As can be seen from FIG. 1, the transmission channel 11 extends along the inner curve of the basic housing 3 in such a way that there is room for a microphone unit 17 on the outer curve. The basic housing 3 has a cover 19 molded into it in this area and in the area of the culmination point of the device is stopped by means of a plug 21. As can be seen especially in FIG. 2, the cover 19 extends along generating line M of the device body, up into the area of the electric/acoustic transducer unit 15, FIG. 1. The microphone unit 17 is accessible when the folding cover 19 is removed and preferably makes electrical contact only on a flexprint strap (not shown), folded over the transmission channel 11 and is on a sound-input slot 23.

When the cover 19 is closed, at least two holes in the microphone unit 17 are opposite an insert 25 in a slot 23 in the cover 19. The insert 25 is acoustically "transparent" and has a large number of passages between the environment U and an equalization volume V, with the latter being left free between the discreet microphone inlet openings (not shown) and said insert. Preferably the insert 25 is made of a sintered material, such as sintered polyethylene, and even more preferably coated so it is water-repellant. It also forms a grid having a fineness between 10 $\mu$m and 200 $\mu$m with an open porousness of preferably over 70%. Furthermore, the microphone unit 17 and the insert 25 are arranged in the slot 23 on the hearing aid 1 so that when the hearing aid is worn, they are exposed, if possible, to no dynamic air pressure from the environment U, by being positioned, as can be seen in FIG. 1, in the area of the cup of the horn-shaped curved, tubular basic body. Especially when an acoustic/electric transducer with directional characteristics is made using at least the two spaced microphones mentioned, due to the intermediate volume V, in the sense of a "common mode" suppression, different coupled equal acoustic signals along the insert 25 have a tendency to be compensated because of the equalizing effect of the volume V.

The insert 25 also protects against dirt and is easy to clean due to its preferred water-repellant coating.

Another advantage of the insert 25 with its large number of passages is that all kinds of dirt have the same effect on both microphones and there is therefore no worsening of the directional effect (directional characteristic), which is a central problem with conventional directional microphones with two and more discrete holes. This is closely coupled with the aspect of the above-mentioned "common mode" suppression.

Please refer to EP-A-0 847 227 by the same applicant concerning this insert 25 and its effects.

After the electric/acoustic transducer arrangement 15 is in the basic housing 3, there is provided an electronic unit 27, then a battery compartment 29. On the outside of the basic housing, in the area between the battery compartment 29 and the electronic unit 27, there is an activating switch 31. The perspective view in FIG. 2 clearly shows in particular the connecting supports 5, the basic housing 3, the cover 19 with the sound-input slot 23 and insert 25, and the activating switch 31.

Battery Compartment

A flat cylindrical battery or a correspondingly molded storage battery 33 is inserted into the battery compartment 29 in the end of the basic housing 3, in such a way that the axis of the battery cylinder, with its front surfaces $\mathbf{33}_u$ and $\mathbf{33}_o$, lies at least basically coaxial relationship to the longitudinal axis A of the basic body.

On the base 30 of the battery compartment 29, centered in axis A, there is a first spring contact 35. A second 37 makes spring contact with the side of the battery 33. The battery compartment 29 can be locked with a cover 39 that is transverse to axis A in the closed position and is swivel- or bayonet-mounted, at 41, on the basic housing 3 or on the battery compartment 29.

This transverse arrangement of the battery 33 on the hearing aid has major advantages. The surface closed by the cover 39 is relatively large and can be used further, as will be described later. Because the battery compartment cover 39 is arranged at the deepest place on the device and the cover impact points are transverse to the axis A to the basic housing 3, penetration of sweat into the battery compartment is barely critical. Furthermore, with this battery compartment design, the contacts 37 and 35 inside the compartment are protected, and the cover 39 has no electrical contacts. Because the basically cylindrical space inside the basic body 3 is used up, there is practically no unused lost space.

Figure 3:
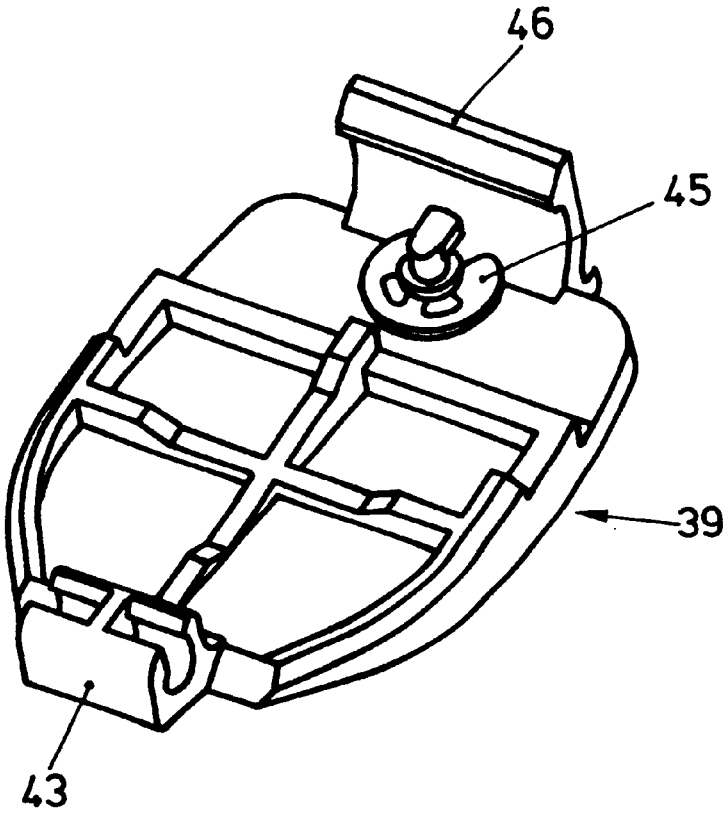
FIG. 3 shows a perspective view of the preferred design of a battery compartment cover on the hearing aid of the invention.

FIG. 3 is a perspective view of one preferred form of embodiment of the battery compartment cover 39, designed as a folding cover. With the snapping hinge part 43, it can be unlatched from the swivel bearing 41, shown in FIG. 1, and locked. In one preferred embodiment, it also has a lock 45, plus a spring catch 46.

Figure 4:
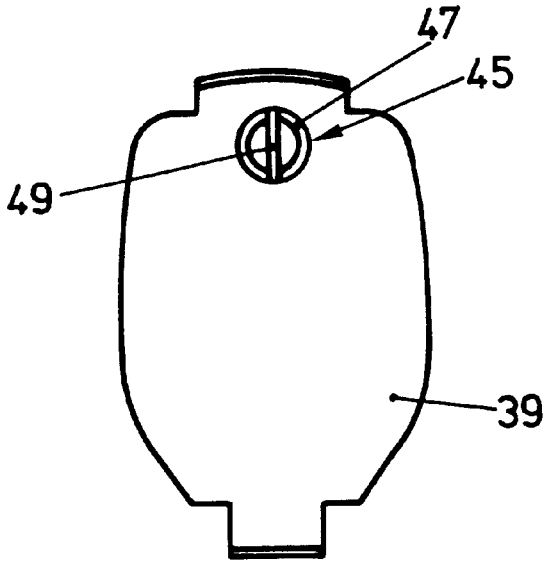
FIG. 4 shows a top view of the cover in FIG. 3 with parts with left-right ear coding.

FIG. 4 shows the cover 29 in FIG. 1 in an outer view. The lock 45 can only be used from the outside with a tool, for example a screw driver and has a slot 49 on a rotating plate 47 for this. The plate 47, which is built onto the folding cover 39 when the lock is mounted is specifically colored in two designs, for example red and blue, so that this part is also used as an indicator of whether the hearing aid in question is for the left or right ear.

As was mentioned, the embodiment of the battery compartment 29 shown, especially the fact that the flat battery cylinder is coaxial to axis A of the hearing aid, has another important advantage. The hearing aid shown in FIG. 1 is a basic configuration.

Figure 5:
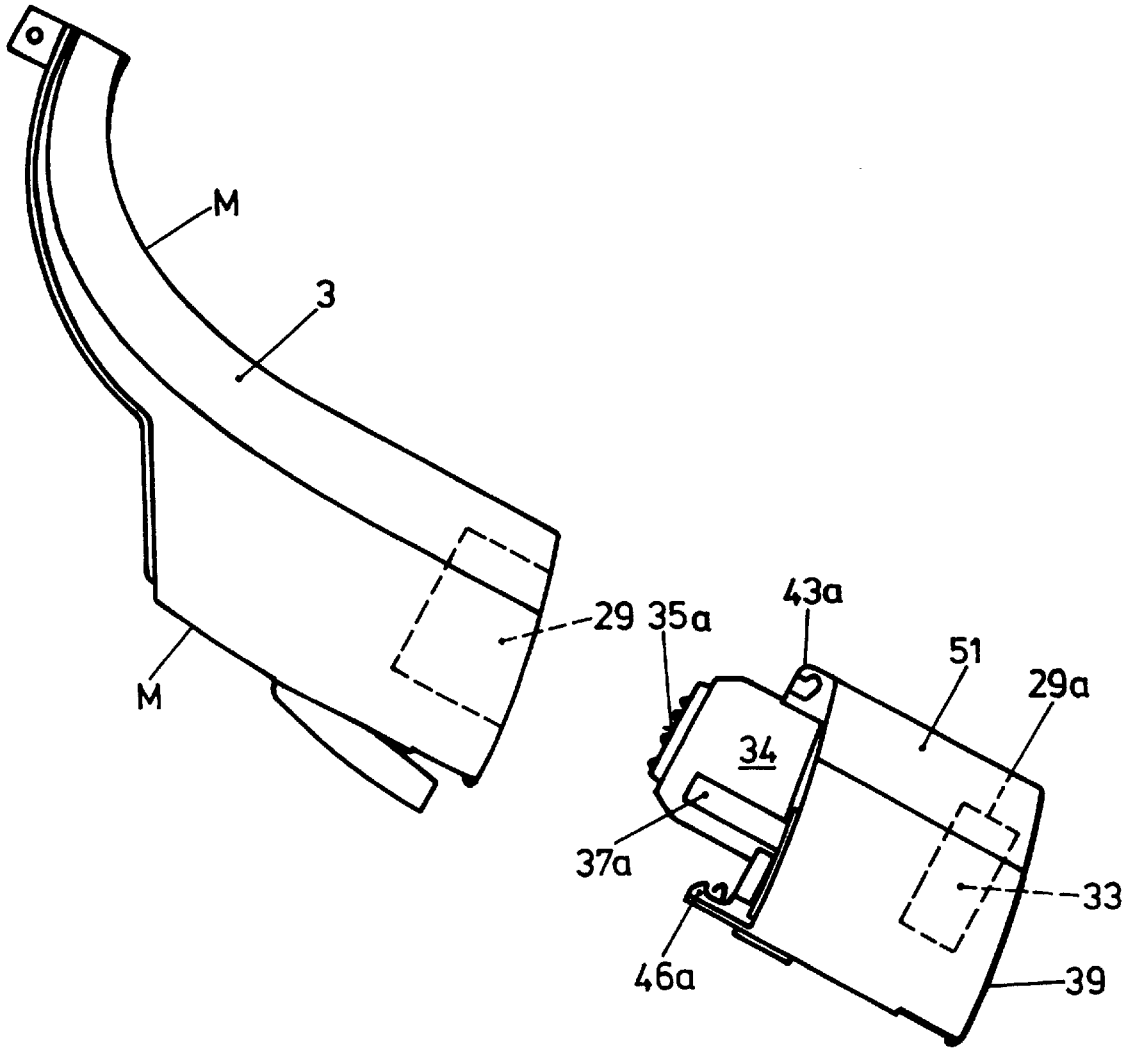
FIG. 5 shows, on one hand, the basic housing of the device of the invention, and on the other hand, an added module that is provided or could be, in a perspective view.

There is often a desire to equip this basic configuration with more options, for example with an interface unit for wireless signal transmission of a programming plug-in unit, another audio input, a larger storage battery compartment, a mechanical activating unit, etc. For this, the battery compartment shown in FIG. 1 is reconfigured as shown in FIG. 5. The battery 33 is taken out of the compartment and instead of it, the plug-in part 34 of a corresponding extra module 51 is plugged in and makes electrical contact at the contact points 35*a* and 37*a* for the battery contacts.

To use such extra modules, it is always possible to provide other contacts in the compartment 29.

The compartment 29*a* now acting as an actual battery compartment with battery 33 is now provided on the extra module 51 and, accordingly, the cover 39, which is removed from the basic housing 3, for example, and snapped onto the extra module or snapped on like a bayonet. If necessary, more such modules 51 can be stacked on the basic module of the hearing aid shown in FIG. 1. The extra modules 51 are preferably attached with a snap-on part 43*a* provided on the modules 51, similar to the hinged part 43 on the folding cover 39, as well as a snapping part 46*a* similar to snapping part 46 on said folding cover 39 or, if there is a bayonet lock, by being pushed in, turned and locked.

Thus it is possible to give the hearing aid the simplest modular design desired so that the battery or storage battery 33 is always accessible from the outside.

Electric/acoustic Transducer Arrangement

Figure 6:
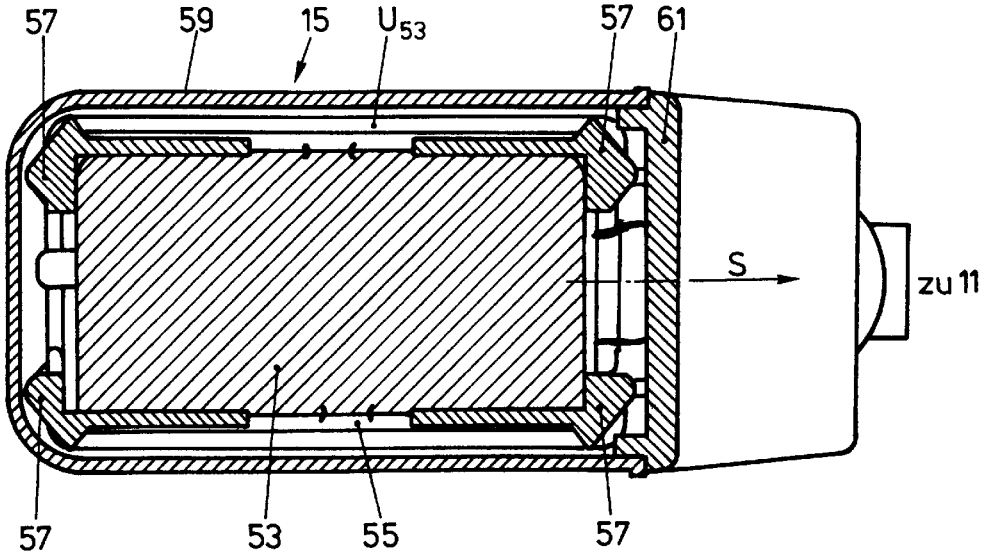
FIG. 6 shows an enlarged view of the electric/acoustic transducer unit on the hearing aid of the invention according to FIG. 1.

FIG. 6 shows a simplified view of the design and mounting of the arrangement 15 mentioned on the basic housing 3 and in the view in FIG. 1. Arrangement 15 includes, encapsulated in a loud-speaker housing 53, the loud-speaker arrangement (not shown) with a loud-speaker membrane. Through coupling holes, shown schematically at 55, the sound waves excited by the loud-speaker membrane from the space on the back of the membrane are coupled in the loud-speaker housing 53 in the surrounding space $U_{53}$ of the loud-speaker housing 53. From the space on the front of the membrane, the acoustic signals, shown by arrow S, are coupled to the transmission channel visible in FIG. 1.

The loud-speaker housing 53 is held on all sides by elastic members, preferably flexible rubber bearings 47, that are basically free to oscillate. The relatively large space $U_{53}$ is defined by the bearings 57 between the outer wall of the loud-speaker housing and a capsule 59, which leads to a substantial increase in the low tones. The resonance space on the back of the membrane is increased by a multiple by space $U_{53}$. Capsule 49 and its holder 61 are sealed to make space $U_{53}$ acoustically effective to the full extent.

Thus, acoustically, the storage volume for the loud-speaker arrangement is optimally use. Capsule 59 also acts preferably as a magnetic shield housing and is preferably made of $\mu$ metal for this. It is designed like a cup and hooked on holder 61, which is designed as a plastic support. The preferable flexible rubber bearings 57 mentioned above are tensed between the capsule 59, and the holder 61 on one side and the loud-speaker housing 53.

Figure 8:
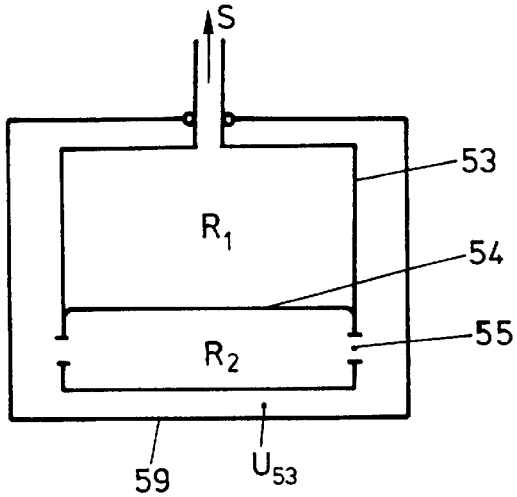
FIG. 8 shows schematically the unit in FIG. 6 to explain the acoustic couplings.

FIG. 8 shows the acoustic coupling explained purely in principle. The membrane 54 of the loud speaker in housing 53 defines in the housing a first space $R_1$, which is coupled to the acoustic output of the hearing aid, shown by S, and a second space $R_2$, which is coupled via one or more holes 55 to space $U_{53}$ formed between the capsule 59 and the housing 53.

Activating Switch 31

Figure 7:
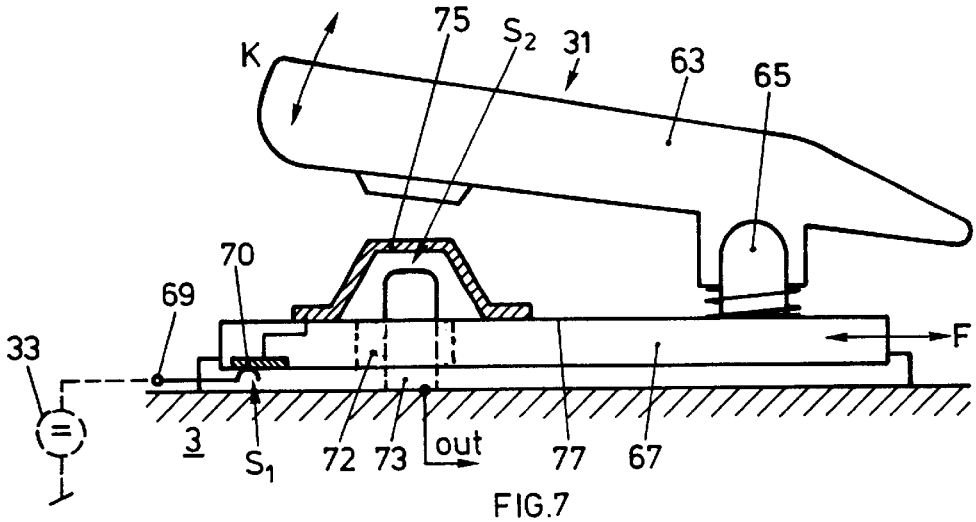
FIG. 7 shows a simplified, schematic view of a preferred activating organ provided on the device of the invention.

FIG. 7 shows a preferred embodiment of the activating switch 31, simplified and schematically drawn. The activating switch 31 includes a tilt button 63, which is mounted on one side at 65 so it can tilt.

The tilt mount 65 is molded on a side 67 which, as shown by double arrow F, is mounted so it can move linearly in relation to the basic housing 3. As shown schematically with the spring contact 69 fixed in relation to the basic housing 3 and the bridge contact 70 on the slide 67, the device is turned on and off by the back and forth movement of the slide via button 63.

The slide 67 has a groove 72 going through it through which a contact pill 73 fixed in the housing 3 projects. This is covered by a spring contact part 75 arranged on the slide 67, which is preferably made as a keyboard element of flexible, at least partially electrically conductive plastic, as is known for example from remote-control keyboards. When the tilt button 63, as shown by double arrow K, is pushed, the contact part 75 comes in contact with the pill 73 and makes an electrical connection between these elements. For the experienced technician, there are a great many possible electrical connections, including a switching strip $S_1$, activated by the slide movement F, and a switching strip $S_2$, activated by the tilting movement K of the tilt button 63. Preferably, as shown in dashes in FIG. 7, the spring contact 69 is connected to the hearing aid battery 33 and the bridge contact 70 to contact part 75, and thus the contact pill 73 works as an electrical output of the switching arrangement.

Thus, the activating switch 31 works both as an on/off switch and also, in the one position, as a toggle switch, which works, for example for fast individual amplification adjustment, in steps on the electronic unit 27 in FIG. 1.

With the activating switch 31, two functions are combined, a push switch and a toggle switch, a function melding that is highly advantageous especially for the behind-the-ear hearing aid in the invention. The operating difference ensures that there is no confusion in function, which is much more critical when two switches are provided for the two functions mentioned.

Design of Housing 3

As can be seen especially in FIG. 5, the basic housing 3 is made up of a curved, correspondingly molded unmachined part. In one preferred embodiment, this part 3 is designed in one piece, preferably of plastic and is not, as is otherwise usual in the design of such hearing aids, able to be separated into two shells along generating lines represented by M in FIG. 5. This permits ease of assembly and use. Another advantage of a tubular, one-piece embodiment is its much greater stability compared to a divided housing. This permits a reduction in the housing wall strength and thus a reduction in the size of it, and with a given outer volume, an increase in the usable inner volume.

Advantages of Overall Configuration

Looking at FIG. 1, it can be seen, especially in the preferred one-piece design of the basic housing 3, that the individual components, especially 11, 15, 27, 29 and/or 51, are assembled by axial sequential insertion into the basic housing 3. The shaping of the housing 3 with corresponding guides ensures fast, precise positioning, and reciprocal electrical contact between the electrically operated units is solderless by means of spring contacting. Thus, the units to be provided can be tested out in advance and measured and assembled afterward with no fear of their being affected in any way. This assembly can definitely be automated. The overall housing with basic housing 3 and cover 19, if necessary 39, is provided with corresponding seals at the points of impact that make it simple to seal tight.

The preferred design of the electric/acoustic transducer arrangement 15 ensures optimum magnetic shielding of the loud speaker and optimal acoustic sealing in relation to body sounds.

What is claimed is:

1. A behind-the-ear hearing aid device comprising:

a hook-shaped housing;

an acoustical output;

a capsule mounted to said hook-shaped housing, wherein said capsule can be removably snapped into place in said hook-shaped housing;

an electrical/mechanical transducer comprising a transducer housing resiliently mounted in said capsule, said transducer housing defining an intermediate space between said transducer housing and said capsule;

a membrane in said transducer housing, said membrane having a first side and a second side;

a first space adjacent said first side of said membrane and communicating with said acoustical output; and a second space adjacent said second side of said membrane and communicating with said intermediate space.

2. The device of claim 1 wherein the capsule is a magnetic shield.

3. The device of claim 2 wherein the capsule comprises $\mu$ metal.

4. The device of claim 1 wherein the capsule is formed as a cup secured to a closing holder, the closing holder being mounted to the hook-shaped housing.

5. The device of claim 1 wherein the capsule comprises a cup-shaped member removably linked to closing member.

6. The device of claim 1 wherein the transducer housing is resiliently mounted in the capsule by elastic mounting members.

7. The device of claim 1 wherein the transducer housing and an inner surface of the capsule are substantially cube-shaped, edges of the transducer housing and the inner surface of the capsule are substantially parallel, and the transducer housing is mounted within the capsule by resilient mounting blocks bridging the transducer housing and the inner surface along respective edge areas.

8. The device of claim 1 wherein said mounting of said capsule establishes electrical contacts of the electrical/mechanical transducer.

9. The device of claim 1 wherein the intermediate space substantially surrounds the transducer casing.

10. The device of claim 1 wherein the capsule is sealed.

* * * * *

UNITED STATES PATENT AND TRADEMARK OFFICE

CERTIFICATE OF CORRECTION

PATENT NO. : 6,549,634 B1
DATED : April 15, 2003
INVENTOR(S) : Andi Vonlanthen

It is certified that error appears in the above-identified patent and that said Letters Patent is hereby corrected as shown below:

Title page,
Item [56], U.S. PATENT DOCUMENTS, please delete “Bucttner”, and enter therefor -- Buettner --.

Column 6,
Line 45, please delete “contacts of the”, and insert therefor -- contacts to the --.

Signed and Sealed this

Twenty-third Day of September, 2003

JAMES E. ROGAN
*Director of the United States Patent and Trademark Office*